United States Patent [19]

Glomeau

[11] Patent Number: 4,557,180

[45] Date of Patent: Dec. 10, 1985

[54] CONTROL VALVE AND HYDRAULIC SYSTEM EMPLOYING SAME

[75] Inventor: J. Robert Glomeau, Dover, Mass.

[73] Assignee: Rexa Corporation, Dover, Mass.

[21] Appl. No.: 479,672

[22] Filed: Mar. 28, 1983

[51] Int. Cl.[4] ..... F15B 11/08; F15B 13/04

[52] U.S. Cl. ..... 91/446; 91/448; 91/454; 91/469; 137/102

[58] Field of Search ..... 91/446, 448, 454, 468, 91/469; 137/881, 102

[56] References Cited

U.S. PATENT DOCUMENTS

| | | | |
|---|---|---|---|
| 2,702,044 | 2/1955 | Johnston | 137/102 |
| 2,858,840 | 11/1958 | Wright, Jr. | 91/454 |
| 3,492,052 | 1/1970 | Klimek | 137/102 |
| 3,638,530 | 2/1972 | Hollister | 91/446 |
| 4,278,010 | 7/1981 | Wallischeck et al. | 91/468 |

*Primary Examiner*—Sheldon J. Richter
*Assistant Examiner*—Randolph A. Smith
*Attorney, Agent, or Firm*—Henry D. Pahl, Jr.

[57] ABSTRACT

The valve disclosed herein functions, in one sense, as a flow matching device and, in another sense, as a reciprocative check valve. By employing the valve, a hydraulic system may be implemented in which filling and emptying of a variable volume load, such as a hydraulic piston may be accomplished through a single check valve structure at controlled flow rates.

8 Claims, 4 Drawing Figures

CONTROL VALVE AND HYDRAULIC SYSTEM EMPLOYING SAME

BACKGROUND OF THE INVENTION

The present invention relates to a flow matching device and more particularly to a check valve structure facilitating simplified control of a hydraulic actuator.

As is understood by those skilled in the art, large process control valves, e.g. such as those employed in petroleum refineries and chemical and power plants are often driven by electrically controllable, hydraulic actuator systems. Such hydraulic actuator systems commonly includes a powerful, single-acting, spring-return hydraulic piston and a positive displacement pump which provides a source of hydraulic power, both for stroking the piston and for holding same at any selected position within its stroke. Typically the pump is run continuously and the pressure to the actuator is modulated by a conventional three way servo valve or equivalent systems means such as a flapper nozzle or jet pipe system which relieve excess pressure to the sump. The servo valve, in turn, is responsive to an electrical command signal employed in conjunction with a position feedback loop.

While the actuator is immobile, the servo valve throttles the pump output in order to create the proper back pressure as required to hold the piston in position and the totality of the flow is returned to the pump sump when the piston is immobile. As a result of the continuous pump operation, the efficiency of present state-of-the-art hydraulic actuators system is, in the large majority of applications, in the order of five percent or less. Inherently a majority of the hydraulic energy generated by the pump is wasted as heat while the actuator is immobile at any intermediate position. As is understood by those skilled in the art, the actuator is, in fact, immobile much of the time in most valve applications, particularly in large and rather stable processes. Not only is the loss of energy wasteful, the heat created is itself troublesome.

Among the several objects of the present invention may be noted the provision of a reciprocative check valve which selectively allows free flow through a single line port in either direction in order to selectively fill or unfill a variable volume load, e.g. to extend or retract the piston of a single-acting, spring-return actuator; the provision of such a reciprocative check valve which requires hydraulic power only when the piston is moving; the provision of such a reciprocative check valve which maintains the piston position's volume with a single positive acting check valve when the piston is immobile; the provision of such a reciprocative check valve which adjusts the flow returning from the actuator to the flow from the hydraulic power source; the provision of such a reciprocative check valve which is of relatively simple and inexpensive construction.

SUMMARY OF THE INVENTION

A hydraulic system in accordance with one aspect of the present invention employs a pump which draws fluid from a sump to provide fluid under pressure. Located between the pump and the load is a reciprocative check valve having first and second mating pairs of valving surfaces which are mechanically coupled and arranged to open in synchronism when the pump pressure exceeds the load pressure. These valving surfaces are connected in series between the pump and the load with the connection between the two pairs of valving surfaces being connected also, through a release valve, to the sump. When the release valve is closed, operation of the pump will expand the load volume and, when the release valve is open, operation of the pump will contract the load volume.

In accordance with another aspect of the invention, the reciprocative check valve or flow matching valve is a device employing a tubular body structure having a source port at a first axial position along the body and a load port at a second position along the body which is axially displaced from the first position. A drain port is located between the source and load ports. In the body, there is a plug member which is movable axially in response to any difference in the pressures at the source and load ports. The plug member includes rigidly connected mating surfaces which progressively open the source and load ports in synchronism. The body and plug member provide, between them, a chamber which is between the source and load ports. The source and load ports communicate with the intermediate chamber when open and a drain port opens directly into the intermediate chamber. Accordingly, when the drain port is closed, a hydraulic flow into the source port will exit through the load port and, when the drain port is open, a hydraulic flow into the source port will produce a controlled flow through the load port, both flows exiting the valve through the drain port.

BRIEF DESCRIPTION OF THE DRAWINGS

Corresponding references characters indicate corresponding parts throughout the several views of the drawings.

DESCRIPTION OF THE PREFERRED EMBODIMENT AND PRIOR ART

Figure 1:
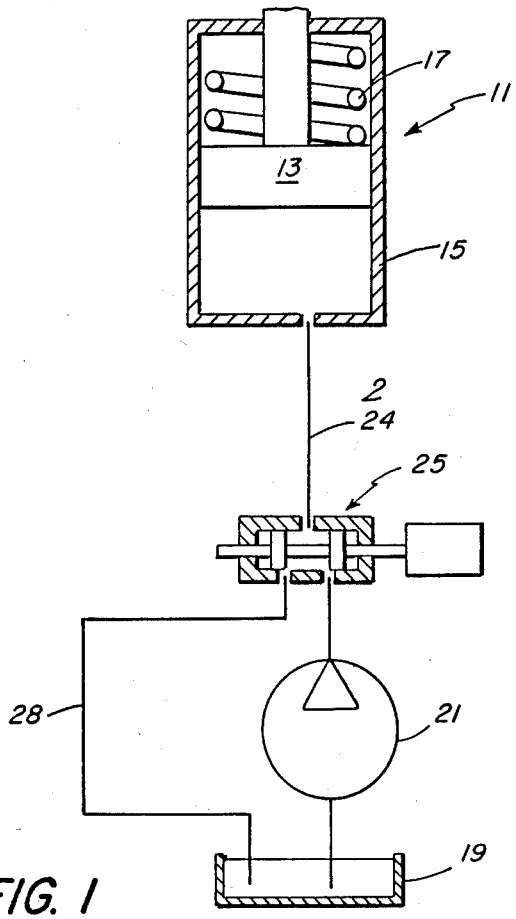
FIG. 1 PRIOR ART
FIG. 1 is a somewhat diagramatic illustration of a conventional circuit hydraulic actuator, i.e. in accordance with the prior art.

As indicated above, hydraulic actuators operating process control valves typically employ a relatively massive hydraulic prime mover. Referring now to FIG. 1, such a mover is indicated generally by reference character 11 and comprises a piston 13 and a cylinder 15. To provide a return force and a modicum of fail safe operation, the piston is normally biased by a heavy spring, as indicated at 17, toward a return position. Hydraulic fluid from a sump 19 is provided under pressure suitable for operating prime mover 11 by a unidirectional pump 21. In the supply line 24 to the cylinder 15, a control valve, e.g. an electrically operated, spool type servo valve 25, is provided for modulating the pressure of the fluid as suitable for moving the prime mover piston or holding it at any position within the stroke range. The excess flow is returned to the pump sump 19 through line 28.

Since most of the state-of-the-art servo valves have a spool construction that generally leaks internally, it will be understood that the piston will drift from its position when the pressure of the hydraulic source is allowed to drop, e.g. by unloading or stopping the pump. It will also be understood that it is normally impossible to put a positive acting check valve between the servo valve and the actuator to prevent such drifting.

Figure 3:
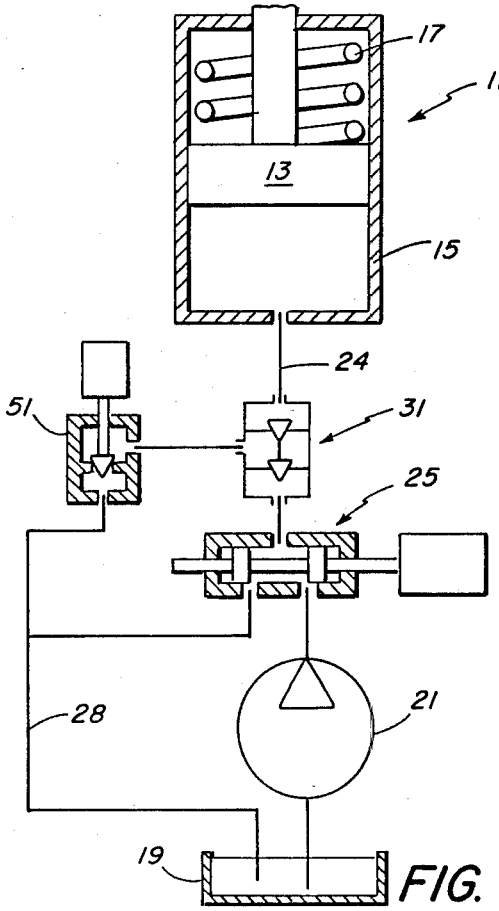
FIG. 3 is a diagramatic illustration of an hydraulic actuator constructed in accordance with the present invention and employing a control valve in accordance with the present invention, that is, of the type illustrated in FIG. 2 or 4.
Figure 2:
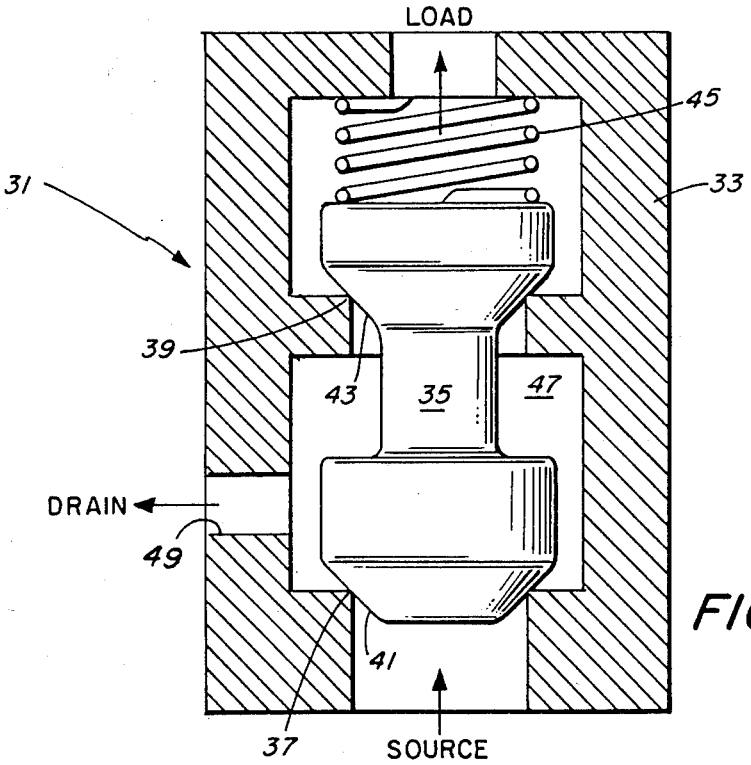
FIG. 2 is a cross sectional view of a reciprocative check valve or flow matching valve constructed in accordance with the present invention.

This problem is alleviated by employing in such an hydraulic actuator circuit a flow-matching or reciprocative check valve in accordance with the present invention. A relatively simple version of such a valve is illustrated in FIG. 3 and serves well for the purpose describing the basic valve function and overall system operation. Referring now to FIG. 2, the valve illustrated there comprises a generally cylindrical or tubular body portion 33 within which operates a plug member 35. The overall control valve structure is designated by reference character 31. The valve body 33 provides a first valve seat 37 and a second valve seat 39 which is axially displaced along the body from the first valve seat. Both valve seats face in the same direction and are of the same diameter.

The plug member 35 includes a first valving surface 41 and a second valving surface 43 which mate with the seats 37 and 39 respectfully. The axial displacement between the valving surfaces 41 and 43 matches the axial spacing of the seats 37 and 39 so that the two ports open synchronously. The port controlled by the valving surface 41 in cooperation with the seat 37 may be considered the source or supply port while the port controlled by the second valving surface 43 in conjunction with the second valve seat 39 may be considered the load port. While the plug member 35 is preferably lightly biased in the direction tending to close the ports, e.g. by a spring 45, the plug member is essentially floating in the body so as to be responsive to any difference in pressure between the supply side and the load side.

The valve body 33 and plug member 35 provide, between them, an intermediate chamber 47. A drain port opens into chamber 47, as indicated at reference character 49. While the valve body 33 and plug member 35 are illustrated as integral structures for the purpose of explanation, it will be understood by those skilled in the mechanical arts that these parts are necessarily assembled of multiple components so as to permit the construction of interlocking assembly shown in the drawings.

The valve 31 of FIG. 2 is functional to provide flow matching characteristics and, in effect, reciprocative check valving. This operation may best be understood in conjunction with the description of an overall system, such as that illustrated in FIG. 3. As may be seen, the control valve of FIG. 2 is installed in the supply line 24. However, the return line 28 is also connected to the drain port of the valve 31. In series with the drain port is a simple two way directional valve, e.g. a solenoid operated on-off valve, designated by reference character 51. As is explained in greater detail hereinafter, the utilization of a simple on/off valve for unfilling the cylinder is possible since the single control valve 25 is functional during both filling and emptying of the piston 13.

At this point, it is useful to consider FIGS. 2 and 3 together. Assuming that the drain port 49 is closed off, i.e. the solenoid valve 51 is closed, it can readily be seen in that a hydraulic flow into the source port of the valve 31 will proceed through the intermediate chamber 47 and on out through the load port. As will be understood, the filling of the cylinder 15 in this situation can be controlled by the operation of the throttling valve 25. Further, when the supply pressure drops below the pressure in the cylinder 15, the control valve 31 acts as a positive operating check valve to prevent any backflow from the piston, even if the servo control valve 25 cannot effect a perfect seal.

To reduce the volume of hydraulic fluid in the cylinder 15, the drain port 49 must be opened i.e., by opening the on/off valve 51. However, the mere opening of this value will not permit the piston to retract if the servo valve is not delivering pressure to the source port. If, though, the servo valve is then operated so that a hydraulic flow is introduced into the source port of the control valve 31 while its drain port is open, it can be seen that this flow will return back to the sump as soon as the source pressure equals the load pressure and moves the plug member 35 sufficiently to open the source port.

However, once the plug member 35 moves, the load port is also opened by the same amount as the source port. As noted previously, the valving surface in the two ports are of equal diameter and, therefore, of equal area. Further, since the pressure on the load side is necessarily about equal to that on the source side and since the drain pressure is the same for the two flows, it can bee seen that the pressure drop across the two valving surfaces will be equal. Accordingly it will be understood that substantially equal flows will occur from the source and load sides. In this way the control valve 31 operates as a flow matching device, that is, the flow out of the piston will be equal to the flow into the source port of the control value 31. As in the filling mode, this flow is controllable by means of the throttling valve 25. In addition, the control valve 31 also operates as a check valve with respect to the return line 30 since, even if the solenoid valve is open and the pump pressure drops below the load pressure, no back flow will take place.

Since the flow out of the piston 31 is controlled by the same servo or throttling valve 25 which controls filling flow and, since the servo valve is operating under essentially the same pressure differential conditions in both situations, it can be seen that essentially symmetrical operation is attained for both filling and emptying of the cylinder and that this will facilitate implementation of an overall servo control system within which such hydraulic actuators are typically employed.

While the operation of the relatively simple valve shown in FIG. 2 is readily understood so that is serves well for the purpose of illustration, it will be understood by those skilled in the art that the balanced operation of such a construction at small flows becomes highly dependent on the accuracy with which the critical dimensions may be matched, i.e. the length of the plug member 35 between the surfaces 41 and 43 as compared with the actual separation between the valve seats 37 and 39. Maintenance of critical dimensions is facilitated with the arrangement shown in FIG. 4 and this construction is presently preferred.

Figure 4:
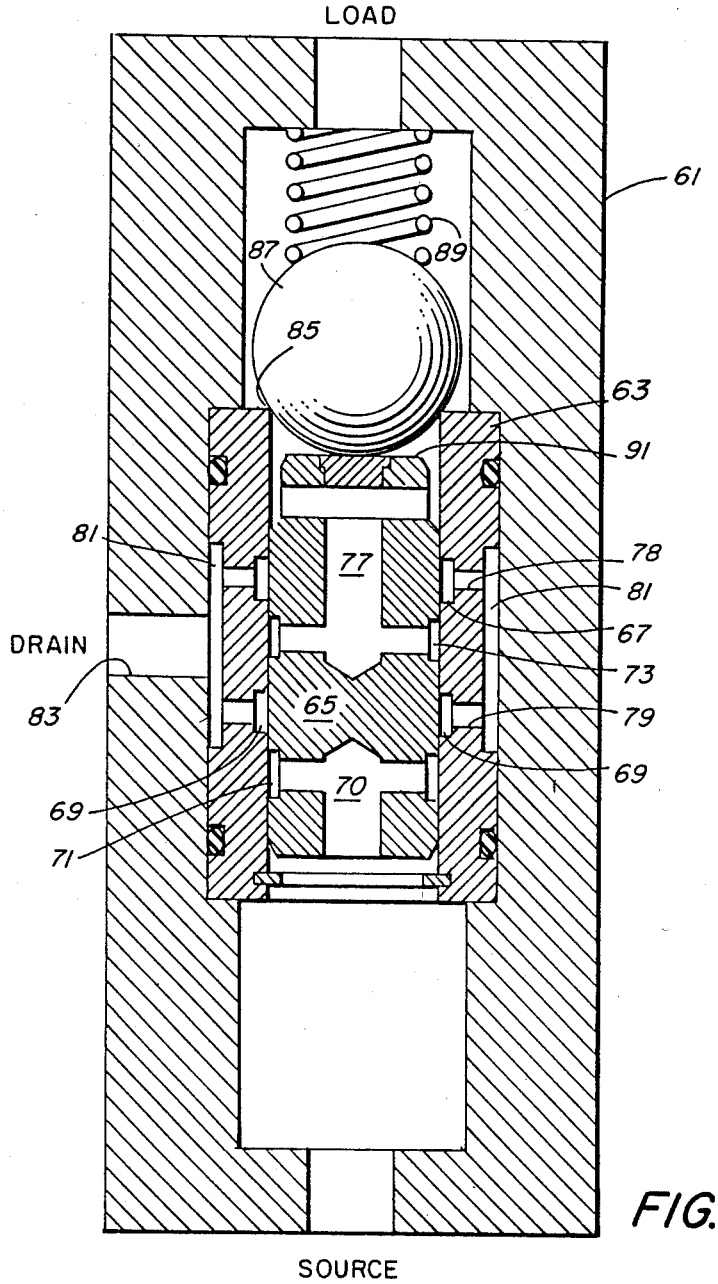
FIG. 4 is a cross sectional view of a preferred mechanical construction of a control valve in accordance with the present invention.

With reference to the device shown in FIG. 4, it will be apparent to those skilled in the art that the constructional techniques are quite similar to those employed in the making of spool valves where close tolerances are regularly achieved. Fitting within an overall body assembly 61 is a sleeve 63 and a piston 65. Sleeve 63 is stationary within the body member 61 while the piston 65 is slidable axially within the sleeve 63, i.e. similar to the manner in which the spool element in a spool valve is slidable. Preferably, the piston is lapped to the sleeve to provide a close, low leakage fit. The sleeve 63 is provided with a pair of internal annular grooves 67 and 69 with a precise axial separation between them. The piston 65 is provided with a matching pair of external annular grooves 71 and 73 with an axial separation between these grooves which matches the axial separation between the grooves 67 and 69 on the sleeve.

Within the piston 65 a first passageway system 70 connects the groove 71 with the source port while a second passageway system 77 provides communication from the groove 73 to the load port end of the sleeve 63. Cross ports 78 and 79 in the sleeve connect the grooves 67 and 69, through a common annular chamber 81, to a drain port connection 83.

The upper end of the sleeve 63 provides a valve seat, as indicated by reference character 85 and a spherical valving element 87 is lightly biased into contact with this seat by a spring 89. A projecting portion 91 of the piston 65 is formed to lift the valving element 87 from the seat 85 just as the annular grooves on the piston come adjacent the respective annular grooves on the sleeve 63.

Ignoring for a moment the action of the spherical valving element 87, it can be understood that the cooperative action of the piston and sleeve portion of the valve is essentially similar to the action provided by the valve of FIG. 2. As the pressure at the source port comes equal to that at the load port, the piston moves upwardly, opening the two valving sections in synchronism. If the drain port is closed, fluid flow introduced into the source port will proceed, through the common intermediate chamber 81 on to the load port. If the drain port is open, however, matching flows from the source port and the load port will both exit through the drain port. These flows will be well matched in volume since the valve openings are closely matched and since the pressure drop in each channel will be equal.

This basic operation is not changed by the presence of the spherical valving element at the top of the sleeve since the spherical valving element 87 is lifted from the valve seat at the same time or slightly before the annular grooves open to each other. However, any time the source pressure drops significantly below the load pressure the spherical valving element acts as a simple but highly effective check valve eliminating backflow from the load. Since the desired sealing requirement is met by this element, there is no requirement for an absolute seal between the piston and the sleeve. Since the overall operation of the valve device of FIG. 4 is basically the same as that of the valve device of FIG. 2, it will also be seen that the valve device of FIG. 4 may be directly substituted in the novel hydraulic system of FIG. 3 which will continue to provide the desired function and advantages.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

I claim:

1. A flow matching control valve comprising;

a tubular body;

a source port at a first axial position along said body;

a load port at a second position along said body which is axially spaced from said first position;

an axially floating plug member which is movable axially within said tubular body in response to any difference in the pressures at said source and load ports, said body including a pair of rigidly connected first and second surfaces which are axially spaced, said plug member including a pair of rigidly connected third and fourth surfaces which are axially spaced, said first and second surfaces simultaneously mating with said third and fourth surfaces, such that axial movement of said plug member will progressively open said source and load ports in synchronism;

said body and plug member providing, between them, a chamber which is located axially between said first and second surfaces and with which said source and load ports communicate when open;

a drain port in said body opening directly into said chamber axially between said first and second surfaces, whereby;

when said drain port is closed, a hydraulic flow into said source port will exit through said load port and, when said drain port is open, a hydraulic flow into said source port will produce a controlled flow from said load port, both flows exiting through said drain port.

2. A control valve as set forth in claim 1 wherein said first and second surfaces comprise valve seats both of which face in the same direction and wherein said third and fourth surfaces comprise conical valving surfaces which are axially spaced so as to mate simultaneously with said valve seats and to open synchronously.

3. A control valve as set forth in claim 1 including, within said body, a generally tubular sleeve and, a piston axially slidable within said sleeve, said sleeve and piston having a first pair of mating valving grooves and, axially displaced from said first pair, a second pair of mating valving grooves, said valving grooves being matched to open to each other in sychronism;

in said piston, a first passageway from said first valving groove to one end of said piston and a second passageway opening from said second valving groove to the other end of said piston;

in said sleeve, passageways connecting both sets of said valving grooves to said drain port.

4. A control valve comprising:

a cylindrical tubular body providing first and second, axially spaced, valve seats both of which face in the same direction;

in said body, a plug member which is movable axially in response to a pressure differential and which includes first and second valving surfaces which are axially spaced so as to mate simultaneously with said seats and to open synchronously;

said body and plug member providing, between them, a chamber which is located axially between said valve seats;

a drain port in said body opening directly into said chamber axially between said seats whereby when said drain port is closed, hydraulic flow in a direction tending to open said valving surfaces will proceed through said body and, when said drain port is open, a hydraulic flow into said body in said one direction will produce a controlled flow in the opposite direction, both flows exiting through said drain port.

5. A control valve comprising;

a generally tubular sleeve;

a piston axially slidable within said sleeve, said sleeve and piston having a first pair of mating valving surfaces and, axially spaced from said first pair, a second pair of mating valving surfaces, said valving surfaces being matched to open in synchronism;

in said piston, a first passageway from said first valving surface to one end of said piston and a second passageway opening from said second valving surfaces to the other end of said piston;

in said sleeve, passageways connecting both sets of said valving surfaces to a drain port at one end of said sleeve, a valve seat;

a valving member adapted to mate with and close off said seat, said piston including a portion which, during movement of the piston, engages said valving member to lift it off said seat substantially at the same time that said mating valving surfaces open.

6. A hydraulic system comprising:

a variable volume load;

a sump;

a unidirectional pump for drawing fluid from said sump and providing fluid under pressure;

a release valve;

between said pump and said load, a reciprocative check valve comprising first and second mating pairs of valving surfaces which are axially spaced and mechanically coupled and arranged to open in synchronism when the pump pressure exceeds the load pressure, and which are connected in series between said pump and said load, said reciprocative check valve providing also a chamber which is located axially between said pairs of valving surfaces, said chamber being connected directly to said release valve and, through said release valve, to said sump whereby, when said release valve is closed, operation of said pump will expand the load volume and, when said release valve is open, operation of said pump will contract the load volume.

7. A hydraulic system comprising:

a variable volume load;

a reservoir a unidirectional pump for drawing fluid from said reservoir and providing fluid under pressure;

a release valve;

between said pump and said load, a reciprocative check valve including:

a tubular body;

a source port at a first axial position along said body;

a load port at a second position along said body which is axially spaced from said first position;

an axially floating plug member which is movable axially responsive to any difference in the pressures at said source and load ports, said body including a pair of rigidly connected first and second surfaces which are axially spaced, said plug member including a pair of rigidly connected third and fourth surfaces which are axially spaced, said first and second surfaces simultaneously mating with said third and fourth surfaces, such that axial movement of said plug member will progressively open said source and load ports in synchronism;

said body and plug member providing, between them, a chamber which is located axially between said first and second surfaces and with which said source and load ports communicate when open;

a drain port in said body opening directly into said chamber axially between said first and second surfaces, the drain port being connected also, through said release valve, to said reservoir whereby, when said release valve is closed, operation of said pump will expand the load volume and, when said release valve is open, operation of said pump will contract the load volume.

8. A hydraulic system comprising:

a variable volume load;

a reservoir;

a unidirectional pump for drawing fluid from said reservoir and providing fluid under pressure;

a release valve;

between said pump and said load, a reciprocative check valve including:

a generally tubular sleeve;

a piston axially slidable within said sleeve, said sleeve and piston having a first pair of mating valving surfaces and, axially spaced from said first pair, a second pair of mating valving surfaces, said valving surfaces being matched to open in synchronism;

in said piston, a first passageway from said first valving surface to one end of said piston and a second passageway opening from said second valving surfaces to the other end of said piston;

in said sleeve, passageways connecting both sets of said valving surfaces to a drain port at one end of said sleeve, a valve seat;

a valving member adapted to mate with and close off said seat, said piston including a portion which, during movement of the piston, engages said valving member to lift it off said seat substantially at the same time that said mating valving surfaces open;

* * * * *